US005890417A

United States Patent [19]

Kim

[11] Patent Number: 5,890,417

[45] Date of Patent: Apr. 6, 1999

[54] PISTON FOR A RECIPROCATING COMPRESSOR

[75] Inventor: Ju Hwan Kim, Suwon, Rep. of Korea

[73] Assignee: Samsung Electronics Co., Ltd., Suwon, Rep. of Korea

[21] Appl. No.: 687,936

[22] Filed: Jul. 29, 1996

[30] Foreign Application Priority Data

Jul. 31, 1995 [KR] Rep. of Korea ..... 1995-23547

[51] Int. Cl.[6] ..... F16J 1/14

[52] U.S. Cl. ..... 92/190; 92/216; 92/219; 92/255; 92/256

[58] Field of Search ..... 92/187, 189, 190, 92/216, 219, 255, 256, 257

[56] References Cited

U.S. PATENT DOCUMENTS

| | | | |
|---|---|---|---|
| 1,185,825 | 6/1916 | Rich | 92/216 |
| 1,601,846 | 10/1926 | Boutell | 92/216 |
| 2,058,261 | 10/1936 | Roberts | 92/216 |
| 2,323,074 | 6/1943 | Neugebauer et al. | 92/216 |
| 2,323,742 | 7/1943 | Webster . | |
| 2,376,214 | 5/1945 | Webster | 92/216 |
| 2,394,175 | 2/1946 | Howald | 92/216 |
| 3,187,643 | 6/1965 | Pope | 92/216 |
| 3,277,797 | 10/1966 | Tyree, Jr. et al. | 92/255 |
| 4,031,868 | 6/1977 | Karaba et al. | 92/82 |
| 4,226,169 | 10/1980 | Mazur et al. . | |
| 5,289,758 | 3/1994 | Berlinger | 92/190 |

FOREIGN PATENT DOCUMENTS

| | | |
|---|---|---|
| 1 354 880 | 2/1964 | France . |
| 233 993 | 4/1911 | Germany . |
| 748 338 | 11/1944 | Germany . |
| 63/68777 | 3/1988 | Japan . |
| 2 136 917 | 9/1984 | United Kingdom . |

*Primary Examiner*—Thomas E. Denion
*Attorney, Agent, or Firm*—Burns, Doane, Swecker & Mathis, L.L.P.

[57] ABSTRACT

A piston/cylinder assembly for a reciprocating compressor has a piston comprising telescopingly connected first and second piston members. The first piston member is connected to a connecting rod. The second piston member is provided with a piston head and is connected to the first piston member in such a way as to be movable axially relative to the first piston member by a predetermined distance. A spring is interposed between the first piston member and the second piston member to yieldably urge the first and second piston members axially apart.

5 Claims, 6 Drawing Sheets

PISTON FOR A RECIPROCATING COMPRESSOR

BACKGROUND OF THE INVENTION

1. Field of the Invention

The present invention relates to a piston/cylinder assembly for a reciprocating compressor.

2. Prior Art

As illustrated in FIG. 7 and 8, a conventional reciprocating compressor used generally for compressing a refrigerant in a refrigerating system is comprised of a driving motor 160 having a stator 163, a rotor 161 and a rotor shaft 165, and a cylinder assembly 200 having a cylinder 139, a piston 120 and a cylinder head 150.

The cylinder head 150 has a suction chamber 151 through which the refrigerant is supplied from the outside and a discharge chamber 152 through which the refrigerant compressed in the cylinder 139 is discharged out of the compressor. Between the cylinder head 150 and the cylinder 139 is interposed a valve seat 111 and a suction valve plate 101. The valve seat 111 is provided with a suction port 117 and a discharge port 115 which are connected to the suction chamber 151 and the discharge chamber 152 of the cylinder head 150, respectively. The discharge port 115 is elastically shut tight by a the discharge valve reed 113 which seats on the valve seat 111 and likewise a suction port 117 is elastically sealed off by the suction valve reed 103 formed on the suction valve plate 101.

When the compressor is activated, the driving motor runs, turning the crank shaft 165 whose resulting rotation is transferred to the piston 120 by means of a connecting rod 131 and changed to a reciprocating movement of the piston 120 in the cylinder 139.

The movement of the piston 120 from the upper dead point to the lower dead point is accompanied with a drop in the pressure of the cylinder compartment. This causes the suction valve reed 103 to bend toward the inner side of the cylinder 139 and results in the opening of the suction port 117 while discharge port 115 is closed off by the discharge valve reed 113. As a consequence, the refrigerant is sucked into the cylinder 139 from the suction chamber 151. In a similar fashion, the movement of the piston 120 from the lower dead point to the upper dead point results in an increase in the pressure inside the cylinder 139. The discharge valve reed 113, as a result, bends toward the outer side of the cylinder 139 to open up the discharge port 115. At this time, the suction port 117 is sealed off by the suction valve reed 103. Consequently, the refrigerant in the cylinder 139 is compressed and discharged to the discharge chamber 152. The refetition of the above process is the mechanism by which the refrigerant is compressed.

At the upper dead point of the piston 120, a gap of about 0.2 mm thick separates the piston 120 and the suction valve plate 101. A larger gap would result in a decrease in the efficiency of the compressor as the compressed high-pressure refrigerant leaves a larger amount of residue inside the cylinder 139. In other words, the high-pressure residual refrigerant expands again as the piston 120 moves from the upper to the lower dead point, and the suction valve reed 103 does not open up until the pressures inside the cylinder 139 and outside the suction valve plate 101 are made equal. The amount of refrigerant intake is therefore much reduced.

However, too small a gap between the piston 120 and the suction valve plate 101 could damage the suction valve plate 101 or the the suction valve reed 103 formed therein from the shocks coming from the high-pressure refrigerant and the refrigerant-oil mixture as the piston 120 move toward the upper dead point. Since the clearance gap between the suction valve plate 101 and the piston shall be determined by a comprimise between the compression efficiency and the suction valve plate's 101 shock tolerance, there's a definite limit to the realizable minimum clearance.

Therefore, it is an object of this invention to provide a cylinder assembly for a reciprocating compressor which has a minimum clearance gap between the piston and the suction valve plate so as to reduce the amount of residual refrigerant whose subsequent expansion lowers the compression efficiency, and yet which reduces the risk of damage to the suction valve plate and reed by the high-pressure refrigerant and oil-refrigerant mixture.

SUMMARY OF THE INVENTION

According to the present invention, the above object is accomplished by cylinder assembly for a reciprocating compressor with a cylinder and a piston which operates in a reciprocating movement in the cylinder. The piston is connected to the connecting rod by means of a piston pin. The piston comprises a first piston member connected to the connecting rod, a second piston member provided with a piston head and connected to the first piston member in such a way as to move relatively to the first piston member for a predetermined length in the axial direction, and a elastically deformable member interposed between the first piston member and the second piston member to urge the first piston member and the second piston member apart from each other.

Preferably, one of the first piston member and the second piston member is inserted in the other. Here, the first piston member and the second piston member may have aligned piston pin holes through which the piston pin passes. The piston pin holes of the second piston member can be formed as a slot in the axial direction of the piston to allow the second piston member to move relatively to the first piston member in the axial direction.

The elastically deformable member may comprise a spring washer interposed between the distal end face of the first piston member and a corresponding face of the second piston member. Further, for lubricating the sliding contact sliding surfaces between the first piston member and the second piston member, an oil groove is preferably formed on at least one of the sliding contact sliding surfaces.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENTS

Figure 1:
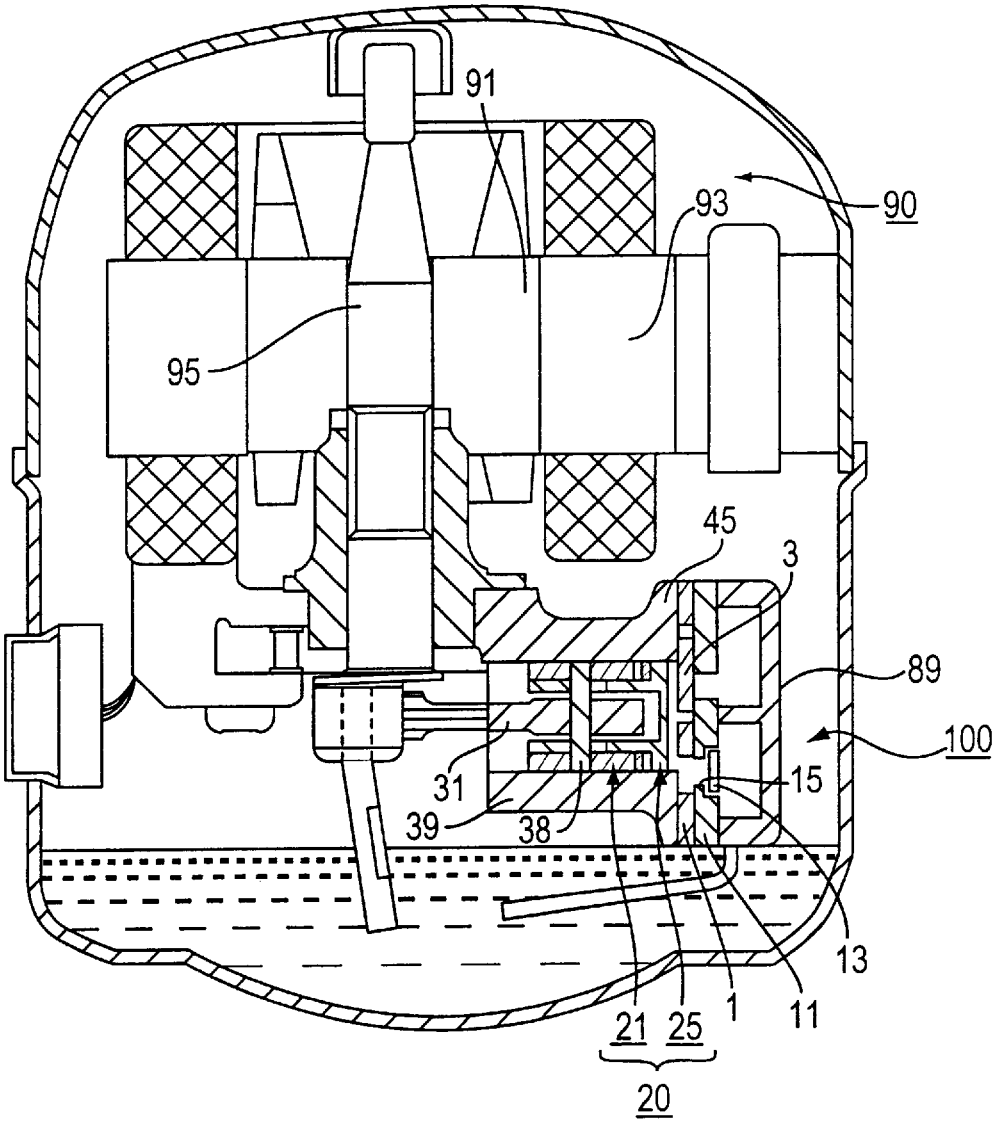
FIG. 1 is a sectional view of the reciprocating compressor according to one preferred example of the present invention.
Figure 7:
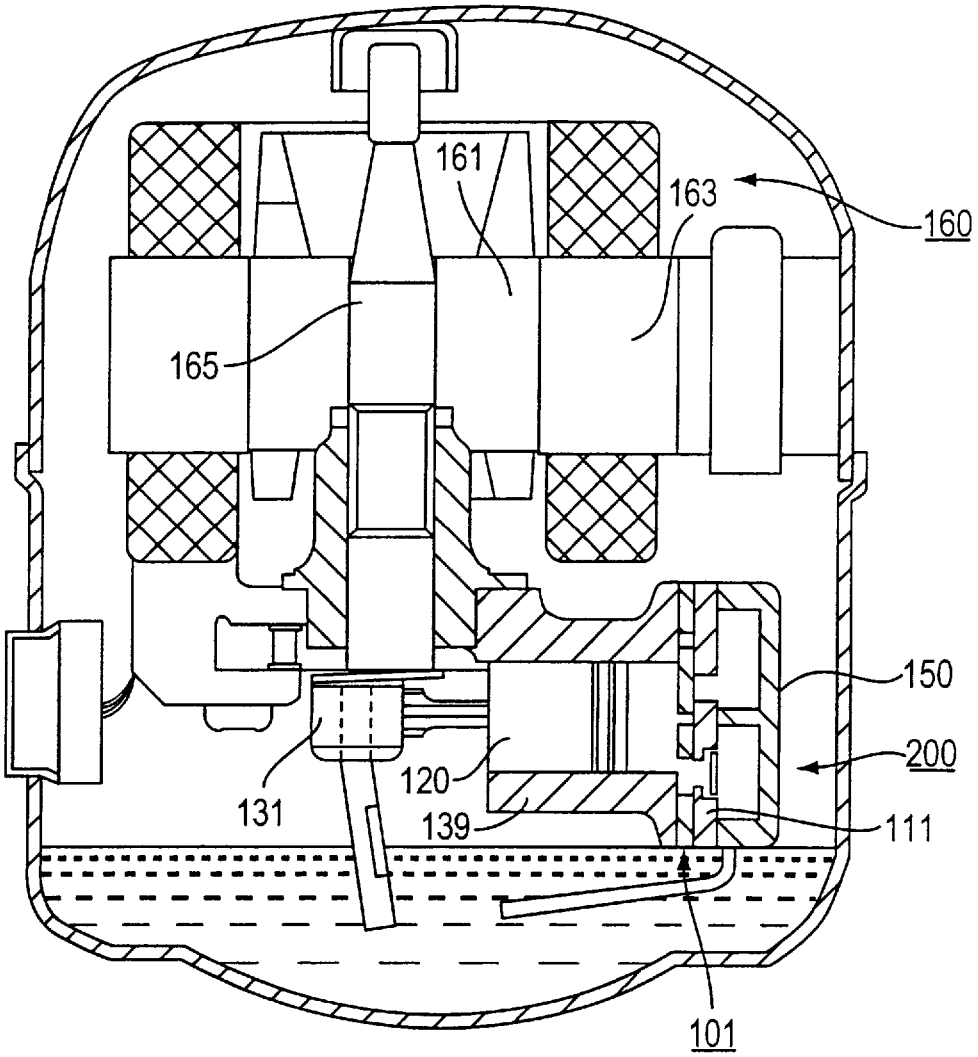
FIG. 7 PRIOR ART
FIG. 7 is a sectional view of a conventional compressor.

FIG. 1 is a sectional view of a reciprocating compressor according to one preferred example of the present invention. The present invention, as in conventional compressors illustrated in FIG. 7, is comprised of a driving motor 90 having a stator 93, a rotor 91 and a rotor shaft 95, and a cylinder assembly 100 having a cylinder 39, a piston 20 and a cylinder head 89.

Between the cylinder 39 and the cylinder head 89, a valve seat 11 is interposed having a suction port 17 and an exhaust port 15, respectively through which the refrigerant is introduced into and exhausted out of the cylinder 39. A suction valve plate 1 is interposed between the valve seat 11 and the cylinder 39, and has a suction valve reed 3 for opening and closing the suction port 17. On the opposite side of the valve seat 11, the exhaust valve reed 13 is disposed so as to open and close the exhaust port 15. The piston 20 reciprocatably accommodated in the cylinder 39 is connected to the rotor shaft 95 by a connecting rod 31.

Figure 2:
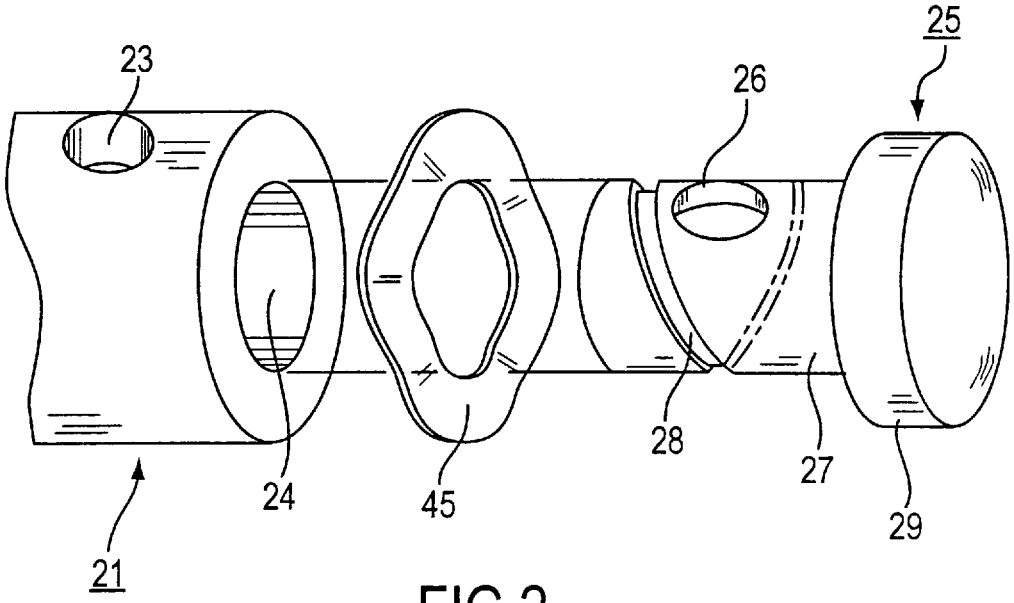
FIG. 2 is an exploded perspective view of a piston shown in FIG. 1, FIGS. 3 and 4 are sectional views of the piston of FIG. 1 in operation.
Figure 3:
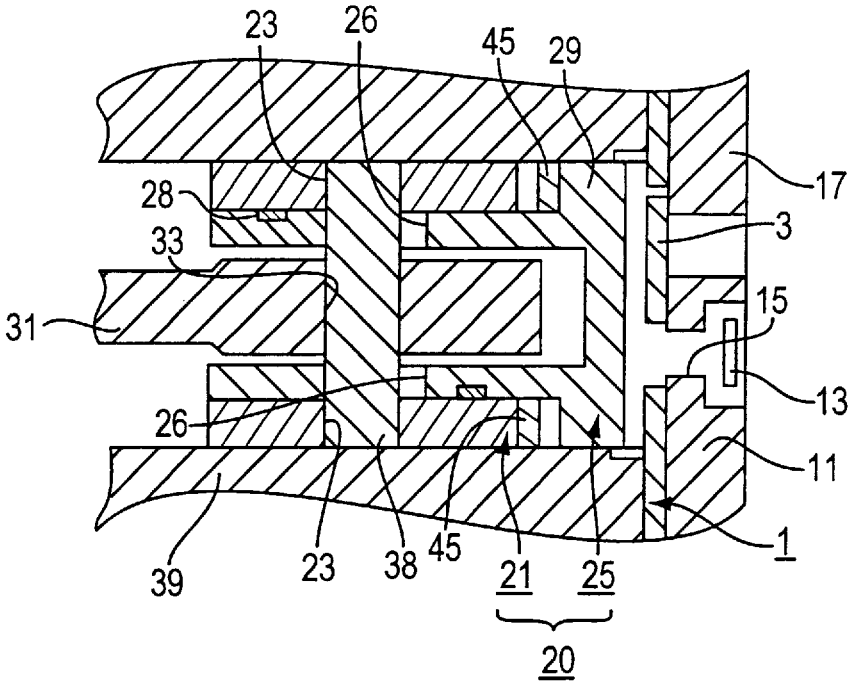

FIG. 2 is a partly exploded perspective view of the piston 20 in FIG. 1. The piston 20 is comprised of a first piston member 21 and a second piston member 25 which is telescopingly disposed within the first piston member. The first piston member 21 has a cylindrical shape of which the inner surface forms a accommodating portion 24. The second piston member 25 has a piston head 29 and a inserting portion 27 inserted in the accommodating portion 24 of the first piston member 21. The second piston member 25 is connected to the first piston member 21 in the axial direction by inserting the inserting portion 27 thereof into the accommodating portion 24 of the first piston member 21. Referring also to FIG. 3 showing a sectional view of the cylinder assembly in an assembled state, the inserting portion 27 of the second piston member 25 has also a cylindrical shape, into which an end of the connecting rod 31 is inserted. The first piston member 21 and the inserting portion 27 of the second piston member 25 have piston pin holes 23, 26 formed transversely to the axial direction of the piston. Here, the piston pin holes 26 of the second piston member 25 are formed as slots elongated in the axial direction. A piston pin 38 passes simultaneously through the piston pin holes 23 and 26 and a connecting hole 33 formed at the end of the connecting rod 31, so as to connect the piston members 21 and 25 with the connecting rod 31. Since the piston pin holes 26 of the second piston member 25 are formed as elongated slots, the second piston member 25 can move freely in the axial direction to a predetermined extent, relative to the first piston member 21. Accordingly, the length of the piston 20 comprised of the first piston member 21 and the second piston member 25 is variable.

Figure 8:
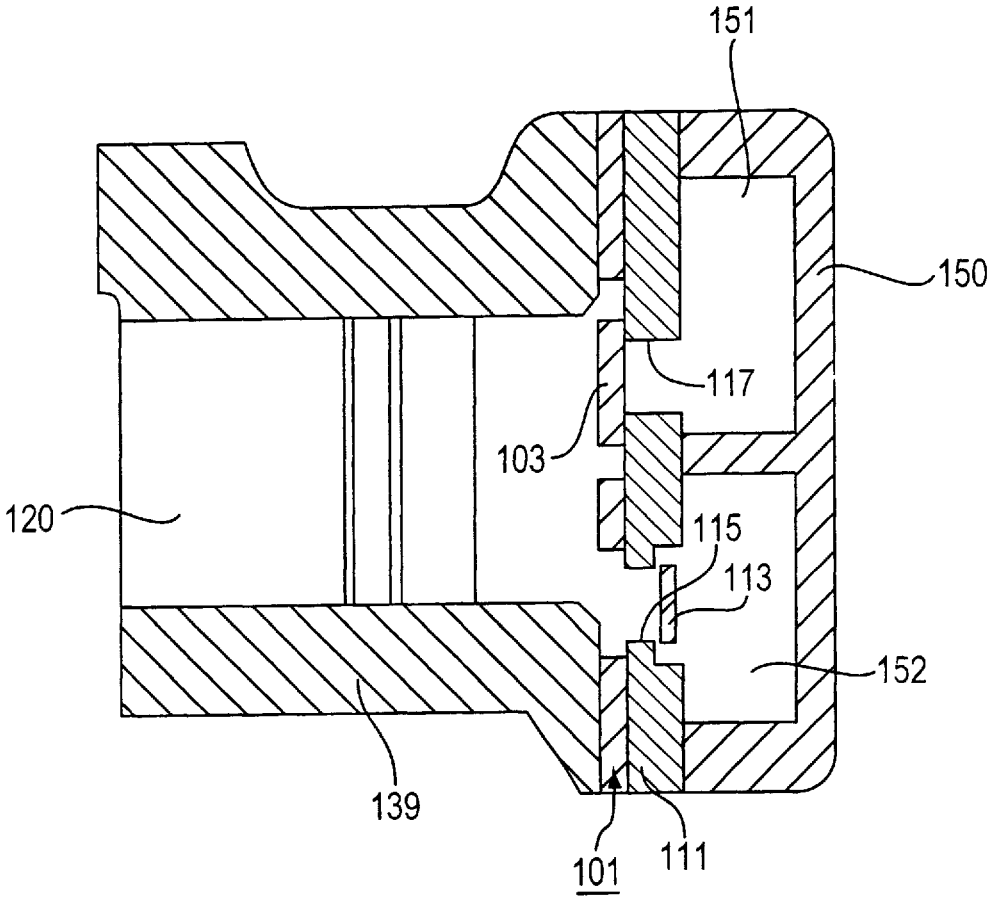
FIG. 8 PRIOR ART
FIG. 8 is a enlarged sectional view of the cylinder assembly of FIG. 7.

A spring washer 45 is interposed between a front end of the first piston member 21 and a corresponding surface of the piston head 29 of the second piston member 25, so as to resiliently urge the first piston member 21 and the second piston member 25 apart from each other. When the first piston member 21 and the second piston member 25 are put apart from each other in the maximum extent, a gap between the piston head 29 and the suction valve plate 1 is advantageously designed to be smaller than that of the cylinder assembly of the conventional compressor illustrated in FIGS. 7 and 8.

Figure 4:
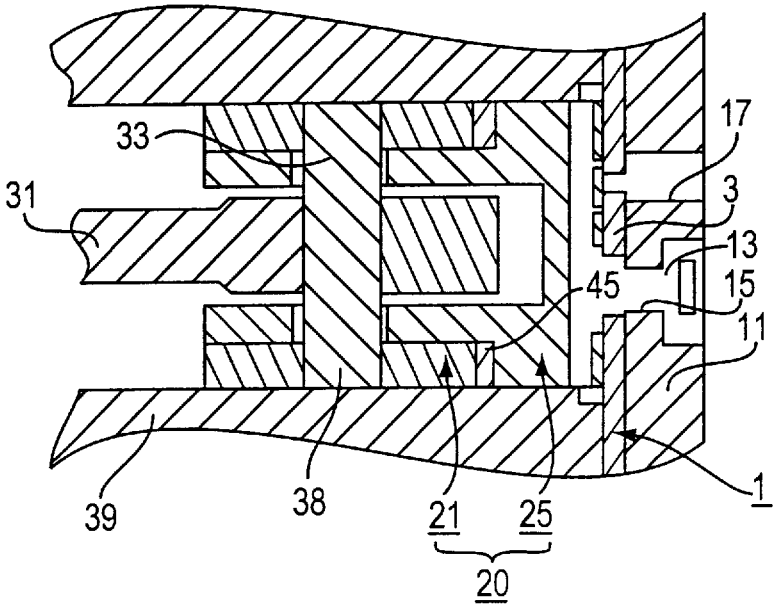

FIGS. 3 and 4 are sectional views of the cylinder assembly in operation. FIG. 3 shows a state wherein the first piston member 21 and the second piston member 25 are put apart from each other to the maximum extent by the spring washer 45, and FIG. 4 shows a state wherein the first piston member 21 and the second piston member 25 are brought closer together against the bias of the spring washer 45.

When the compressor oprates, the piston 20 reciprocates in the cylinder 39. The movement of the piston 20 from the upper dead point to the lower dead point is accompanied with a drop in the pressure of the cylinder compartment. This causes the suction valve reed 3 to bend toward the inner side of the cylinder 39 and results in the opening of the suction port 17 while discharge port 15 is closed off by the discharge valve reed 13. As a consequence, the refrigerant is sucked into the cylinder 39 from the suction chamber 51. In a similar fashion, the movement of the piston 20 from the lower dead point to the upper dead point results in an increase in the pressure inside the cylinder 39. The discharge valve reed 13, as a result, bends toward the outer side of the cylinder 39 opening up the discharge port 15. The suction port 17 is sealed off by the suction valve reed 03. Consequently, the refrigerant in the cylinder 39 is compressed in and discharged from the cylinder 39.

In the compression stroke of the piston 20, if the pressure of the compressed refrigerant does not surpass the resilient force of the spring washer 45, the spring washer 45 expands at its maximum to allow the piston 20 to have its maximum length, as shown in FIG. 3. At this time, the gap between the piston head 29 of the second piston member 25 and the suction valve plate 3 becomes the minimum. Since that minimum gap is advantageously designed to be smaller than that of the conventional compressor, the amount of the residual refrigerant left in the gap is reduced as compared to the conventional compressor, resulting in reduced re-expansion of the residual refrigerant and an increase in the amount of the sucked refrigerant. Consequently the compressor efficiency is improved.

When the pressure of the compressed refrigerant surpasses the resilient force of the spring washer 45, the spring washer 45 contracts to bring the first piston member 21 closer to the second piston member 25. It makes the piston 20 have its minimum length, as shown in FIG. 4. Accordingly, the gap between the piston head 29 of the second piston member 25 and the suction valve plate 3 becomes the maximum. That is, the excessive pressure of the refrigerant is absorbed by the spring washer 45 to prevent the suction valve reed 1 from receiving a pressure shock. When the piston 20 begins to move from the top dead point to the lower dead point, the spring washer 45 leaves the second piston member 25 at the top dead point as the spring washer 45 expands, thereby maintaining the gap volume. In other words, the second piston member 25 remains at the top dead point for a longer while, to lengthen the discharge time of the compressed refrigerant through the discharge port 15. Accordingly, It results in increasing the amount of the discharged refrigerant, and decreasing the re-expansion of the residual compressed refrigerant.

Consequently, regardless of a variation in the pressure of the compressed refrigerant in the cylinder 39, the amount of residual refrigerant whose expansion lowers the compression efficiency can be minimized, and the risk of damage to the suction valve plate and reed by the high-pressure refrigerant and oil-refrigerant mixture can be apparently reduced.

There is provided an oil groove 28 on the outer cylindrical surface of the inserting portion 27 of the second piston member 25. The oil groove 28 supplies oil to the contact sliding surfaces between the first piston member 21 and the second piston member 25 to lubricate the contact sliding surfaces. Moreover, the oil supplied by the oil groove can be applied to the contact sliding sufaces between the piston members 21, 25 and the cylinder 39 through the gap provided by the spring washer 45, to lubricate the contact sliding sufaces between the piston members 21, 25 and the cylinder 39.

Figure 5:
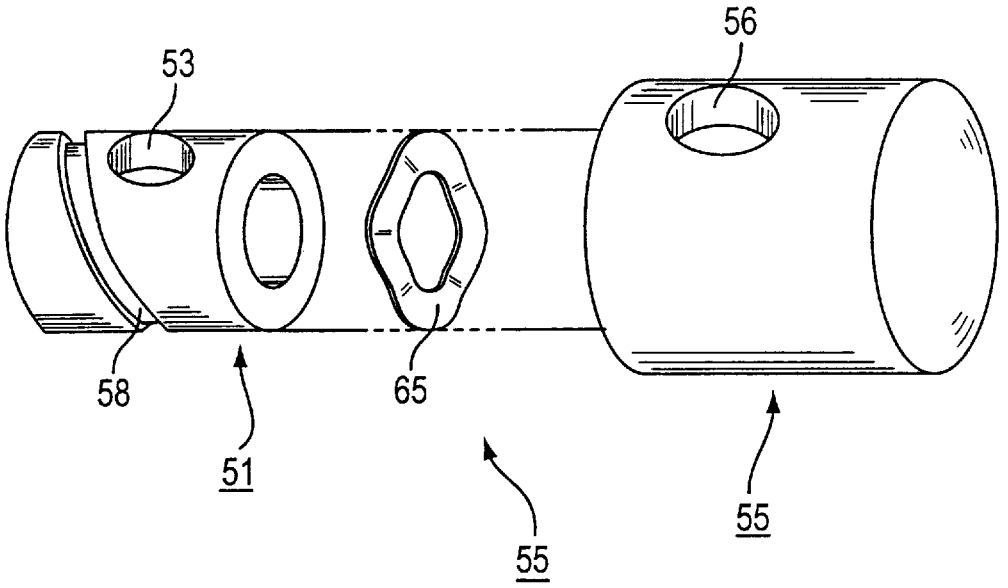
FIG. 5 is an exploded perspective view of a piston according to another example of the present invention.

FIG. 5 is an exploded perspective view of the piston according to another example of the present invention. The piston 50 has also a first piston member 51 and a second piston member 55. In this example, the first piston member 51 is disposed within the second piston member 55, contrary to the first example according to the FIGS. 1 to 4. Both piston members 51 and 55 have cylindrical shape. A spring washer 45 is interposed between a front end of the first piston member 51 and a corresponding inner surface of the second piston member 55. The first piston member 51 and the second piston member 55 have piston pin holes 53, 56 formed transversely to the axial direction. The piston pin holes 56 of the second piston member 55 are formed as slots elongated in the axial direction. A piston pin 38 passes simultaneously through the piston pin holes 53 and 56 and the connecting rod, so as to connect the piston members 51 and 55 with the connecting rod. Since the piston pin holes 56 of the second piston member 55 are formed as elongated slots, the second piston member 55 can move freely in the axial direction to a predetermined extent, relative to the first piston member 51. The first piston member 51 is formed with an oil grove 58 on the outer surface thereof, for lublcating the contact sliding surfaces between the first piston member 51 and the second piston member 55. The piston 50 operates in the same manner as the piston 20 of the first example.

Figure 6:
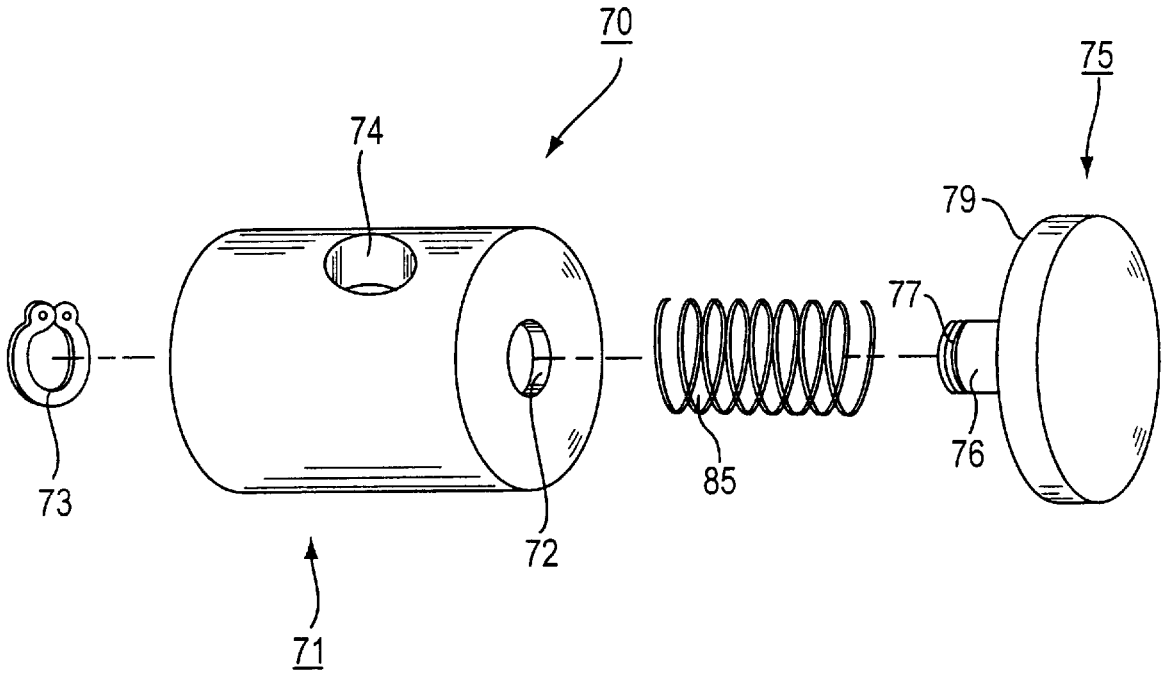
FIG. 6 is an exploded perspective view of a piston according to yet another example of this invention.

FIG. 6 is an exploded perspective view of the piston according to yet another example of this invention. The piston 70 has also a first piston member 71 and a second piston member 75. The first piston member 71 has piston pin holes 74, while the second piston member 75 is not provided with piston pin holes. The first piston member 71 has a connecting hole 72 formed on the front end thereof in the axial direction. The second piston member 75 has a piston head 79 and an being inserted portion 76 capable of inserting into the connecting hole 72 in the axial direction. A free end of the inserting portion 76 is formed with a snap ring groove 77 for engaging with a snap ring 73 for preventing the inserting portion 76 from escaping out of the connecting hole 72. The inserting portion 76 has a length enough for allowing the second piston member 75 to move freely in the axial direction to a predetermined extent, relative to the first piston member 71. A spring 85 is interposed between a front end of the first piston member 71 and a corresponding surface of the second piston member 75 to resiliently urge the first piston member 71 and the second piston member 75 apart from each other. The piston 70 operates in a same manner as the pistons 20 and 50 of the first and second examples.

As described above, according to the present invention, provided is a cylinder assembly of a reciprocating compressor, by which the gap clearance and thus the amount of the residual refrigerant is minimized to decrease re-expansion of the residual refrigerant and increase the amount of the sucked refrigerant, and consequently to improve the compressor efficiency. At the same time, The risk of damage to the suction valve plate and reed by the high-pressure refrigerant and oil-refrigerant mixture can be reduced.

What is claimed is:

1. A reciprocating compressor comprising a cylinder having a valved outlet, and a piston mounted for axial reciprocation in the cylinder for compressing gas and discharging the compressed gas through the valved outlet, the piston comprising:

a first piston member adapted to be connected to a connecting rod;

a second piston member having a piston head and connected to the first piston member for axial movement relative thereto by a predetermined extent; and a spring washer disposed between portions of the first and second piston members for yieldably biasing the first and second piston members axially apart.

2. The reciprocating compressor according to claim 1 wherein the first and second piston members are telescopingly connected together.

3. The reciprocating compressor according to claim 2 wherein the first and second piston members include aligned lateral holes for receiving a piston pin for connecting the piston to a connecting rod; the hole in the second piston member comprising an axial slot enabling the second piston member to reciprocate relative to the first piston member and the connecting rod.

4. The reciprocating compressor according to claim 1 wherein an oil groove is formed on a surface of one of the first and second piston members which slides against a surface of the other of the first and second piston members.

5. A reciprocating compressor comprising:

a motor;

a drive shaft rotated by the motor;

a connecting rod, one end of which being connected to the shaft;

a cylinder forming a bore;

a valve plate disposed at one end of the bore for discharging compressed gas and admitting gas to be compressed; and a piston mounted for axial reciprocation in the bore and connected to another end of the connecting rod, the piston comprising:

first and second piston members interconnected to enable the second piston member to reciprocate axially relative to the first piston member by a predetermined extent, the first piston member connected to the connecting rod, and the second piston member having a piston head facing the valve plate, and a washer spring interposed between portions of the first and second piston members for yieldably biasing the first and second piston members axially apart.

* * * * *